US011087944B2

(12) United States Patent
Kang et al.

(10) Patent No.: US 11,087,944 B2
(45) **Date of Patent: *Aug. 10, 2021**

(54) CIRCUIT PROTECTION DEVICE

(71) Applicant: SMART ELECTRONICS INC., Ulsan (KR)

(72) Inventors: Doo Won Kang, Gyeonggi-do (KR); A Lam Shin, Busan (KR)

(73) Assignee: SMART ELECTRONICS INC., Ulsan (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/016,491

(22) Filed: Sep. 10, 2020

(65) Prior Publication Data

US 2021/0082652 A1 Mar. 18, 2021

(30) Foreign Application Priority Data

Sep. 12, 2019 (KR) ..... 10-2019-0113185

(51) Int. Cl.

| | |
|---|---|
| ***H01H 85/055*** | (2006.01) |
| ***H01H 85/165*** | (2006.01) |
| ***H01H 85/02*** | (2006.01) |
| ***H01C 7/04*** | (2006.01) |
| ***H01H 85/143*** | (2006.01) |

(52) U.S. Cl.

CPC ..... *H01H 85/055* (2013.01); *H01C 7/04* (2013.01); *H01H 85/0241* (2013.01); *H01H 85/143* (2013.01); *H01H 85/165* (2013.01)

(58) Field of Classification Search

CPC ..... H01H 85/055; H01H 85/0241; H01H 85/143; H01H 85/165; H01H 85/175; H01H 85/1755; H01H 2085/0412; H01C 7/04

See application file for complete search history.

(56) References Cited

U.S. PATENT DOCUMENTS

| | | | | |
|---|---|---|---|---|
| 4,644,316 A * | 2/1987 | Takeuchi | G05D 23/2401 | 219/544 |
| RE33,137 E * | 12/1989 | Gurevich | H01H 85/0417 | 337/255 |
| 5,621,602 A * | 4/1997 | Winkelmann | H01H 85/048 | 337/184 |
| 2009/0121822 A1* | 5/2009 | Jeong | H01C 7/123 | 338/20 |
| 2012/0032774 A1* | 2/2012 | Jung | H01H 69/02 | 337/414 |
| 2012/0038450 A1* | 2/2012 | Jung | H01H 85/175 | 337/184 |

(Continued)

*Primary Examiner* — Jacob R Crum

(74) *Attorney, Agent, or Firm* — Harness, Dickey & Pierce, P.L.C.

(57) ABSTRACT

Disclosed is a circuit protection device including a case, a negative temperature coefficient thermistor which is accommodated in the case and includes a resistant heating element, a pair of electrodes installed on both sides of the resistant heating element, and a first lead wire and a second lead wire withdrawn from the pair of electrodes, respectively, and a thermal fuse which is accommodated in the case and includes a thermal fuse body and a third lead wire and a fourth lead wire connected to both ends of the thermal fuse body, respectively. Here, the second lead wire and the third lead wire are connected to each other in the case.

12 Claims, 10 Drawing Sheets

(56) References Cited

U.S. PATENT DOCUMENTS

| | | | | |
|---|---|---|---|---|
| 2015/0262775 | A1* | 9/2015 | Kang | H01H 37/761<br>337/414 |
| 2015/0294826 | A1* | 10/2015 | Kim | H01H 85/06<br>337/382 |
| 2018/0047539 | A1* | 2/2018 | Kang | H01H 85/048 |

* cited by examiner

CIRCUIT PROTECTION DEVICE

CROSS-REFERENCE TO RELATED APPLICATION

This application claims priority to and the benefit of Korean Patent Application No. 2019-0113185, filed on Sep. 12, 2019, the disclosure of which is incorporated herein by reference in its entirety.

FIELD

The present invention relates to a circuit protection device, and more particularly, to a circuit protection device configured to limit an inrush current when an electronic product is initially driven and to prevent fire caused by an increase in internal temperature or overcurrent.

BACKGROUND

In general, in an electric circuit of a large electronic product such as an air conditioner, a washer, a refrigerator, a dryer, or the like, a circuit protection device is provided at a power input terminal of the electric circuit and protects a power circuit to prevent a failure caused by an inrush current, an increase in internal temperature, a continuous overcurrent, and the like which occur when power is turned on.

FIG. 1 illustrates components and operations of an existing circuit protection device. The existing circuit protection device includes a fuse resistor RF, a first relay S1 connected to the fuse resistor RF in a series, and a second relay S2 connected to the fuse resistor RF and the first relay S1 in parallel. The fuse resistor RF includes a resistor R and a thermal fuse F, and the resistor R and the thermal fuse F are connected to each other in series.

In the circuit protection device, state (a) in which the first relay S1 is closed and the second relay S2 is opened at a driving time is converted into state (b) in which the first relay S1 is opened and the second relay S2 is closed after a certain time.

In state (a), an input current passes through the fuse resistor RF and the first relay S1 and is input to an electrical circuit. Here, when the resistor R limits an inrush current to a certain current and an overcurrent flows thereinto, heat generated by the resistor R is conducted to the thermal fuse F and short-circuits a circuit to fuse a fused body including solid lead or polymer pellets provided inside the thermal fuse F so as to protect an electrical circuit of a home appliance. After a certain time (for example, about 0.5 seconds) in which the inrush current disappears and the input current is stabilized, the circuit protection device is changed to state (b) so that a normal input current passes through the second relay S2 and is input to the electrical circuit.

Since the circuit protection device includes three components including the fuse resistor RF and the first relay S1 and the second relay S2 which have a relatively great volume, costs are high and a larger space is occupied. Also, a normal input current is within a range from 2 A to 4 A in the case of a washer and is 7 A or higher in the case of a dryer. Accordingly, it is necessary to use high-current relays for the first relay S1 and the second relay S2. Here, since the high-current relays are high-priced and there are less commercialized domestic goods, most high-current relays have to be imported from Japan and the like.

In addition, since operations of the first relay S1 and the second relay S2 being opened and closed are repetitively performed whenever an electronic product is turned on or off, durability thereof decreases. Accordingly, as the electronic product is used for a long time, malfunctions occur. The malfunctions of the first relay S1 and the second relay S2 may cause an inflow of an overcurrent or even cause fire. Accordingly, such risks are inherent all the time in the circuit protection device using relays.

SUMMARY

The present invention is directed to providing a circuit protection device capable of replacing a circuit protection device, which includes a fuse resistor RF, a first relay S1, and a second relay S2, as well as reducing costs and less occupying a space without using relays.

Aspects of the present invention are not limited to the above-stated aspects and other unstated aspects of the present invention will be understood by those skilled in the art from a following description.

According to an aspect of the present invention, there is provided a circuit protection device including a case, a negative temperature coefficient thermistor which is accommodated in the case and includes a resistant heating element, a pair of electrodes installed on both sides of the resistant heating element, and a first lead wire and a second lead wire withdrawn from the pair of electrodes, respectively, and a thermal fuse which is accommodated in the case and includes a thermal fuse body and a third lead wire and a fourth lead wire connected to both ends of the thermal fuse body, respectively. Here, the second lead wire and the third lead wire are connected to each other in the case.

The circuit protection device may further include a first pin connected to the first lead wire and a second pin connected to the fourth lead wire. Here, a first guide groove configured to guide the first pin to be withdrawn outward from the case and a second guide groove configured to guide the second pin to be withdrawn outward from the case may be formed in the case.

The first pin and the second pin may include plate-shaped bodies having one sides connected to the first lead wire and the fourth lead wire, respectively, and may each include at least one extending portion extending from the other side of the body with a width smaller than that of the body.

The bodies of the first pin and the second pin may include first parts having one sides connected to the first lead wire and the fourth lead wire and inserted into the first guide groove and the second guide groove, respectively, and may include second parts having one sides extending from other sides of the first parts with a width greater than that of the first parts and withdrawn outward from the case.

The case may include a partition wall extending from an internal wall of the case and disposed between the resistant heating element and the thermal fuse body.

According to another aspect of the present invention, there is provided a circuit protection device including a case, a first negative temperature coefficient thermistor which is accommodated in the case and includes a first resistant heating element, a pair of electrodes installed on both sides of the first resistant heating element, and a first lead wire and a second lead wire withdrawn from the pair of electrodes, respectively, a second negative temperature coefficient thermistor which is accommodated in the case and includes a second resistant heating element, a pair of electrodes installed on both sides of the second resistant heating element, and a third lead wire and a fourth lead wire withdrawn from the pair of electrodes, respectively, and a thermal fuse which is accommodated in the case and includes a thermal fuse body and a fifth lead wire and a sixth lead wire connected to both ends of the thermal fuse body, respectively. Here, the first lead wire and the third lead wire are connected to each other in the case, and the second lead wire, the fourth lead wire, and the fifth lead wire are connected to one another in the case.

The circuit protection device may further include a first pin connected to the first lead wire and the third lead wire and a second pin connected to the sixth lead wire. Here, a first guide groove configured to guide the first pin to be withdrawn outward from the case and a second guide groove configured to guide the second pin to be withdrawn outward from the case may be formed in the case.

The first pin may include a plate-shaped body having one side connected to the first lead wire and the third lead wire and may include at least one extending portion extending from the other side of the body with a width smaller than that of the body.

The body of the first pin may include a first part having one side connected to the first lead wire and the third lead wire and inserted into the first guide groove and may include a second part extending from another side of the first part with a width greater than that of the first part to be located outside the case.

The second pin may include a plate-shaped body having one side connected to the sixth lead wire and may include at least one extending portion extending from the other side of the body with a width smaller than that of the body.

The body of the second pin may include a first part having one side connected to the sixth lead wire and inserted into the second guide groove and may include a second part extending from another side of the first part with a width greater than that of the first part to be located outside the case.

The case may include a partition wall extending from an internal wall of the case and disposed between the thermal fuse body and the first resistant heating element and the second resistant heating element.

The first resistant heating element and the second resistant heating element may be disposed to face each other.

The circuit protection device may include a first cable having one end connected to the first lead wire and the third lead wire and a second cable having one end connected to the sixth lead wire. Here, a first guide groove configured to guide the first cable to be withdrawn outward from the case and a second guide groove configured to guide the second cable to be withdrawn outward from the case may be formed in the case.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION

Figure 1:
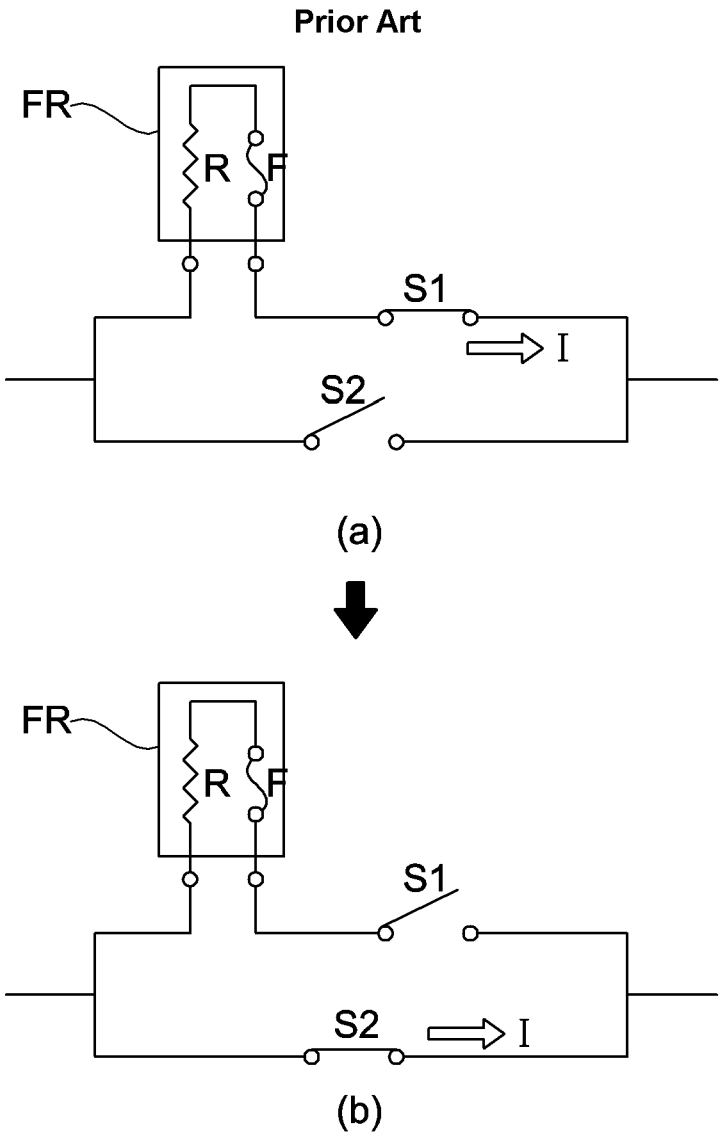
FIG. 1 illustrates components and operations of an existing circuit protection device.

Hereinafter, exemplary embodiments of the present invention will be described in detail with reference to the drawings. Hereinafter, throughout the description and the attached drawings, substantially like elements will be referred to as like reference numerals and a repetitive description thereof will be omitted. Also, in a description of the embodiments of the present invention, a detailed description of well-known functions or components of the related art will be omitted when it is deemed to obscure understanding of the embodiments of the present invention.

Figure 2:
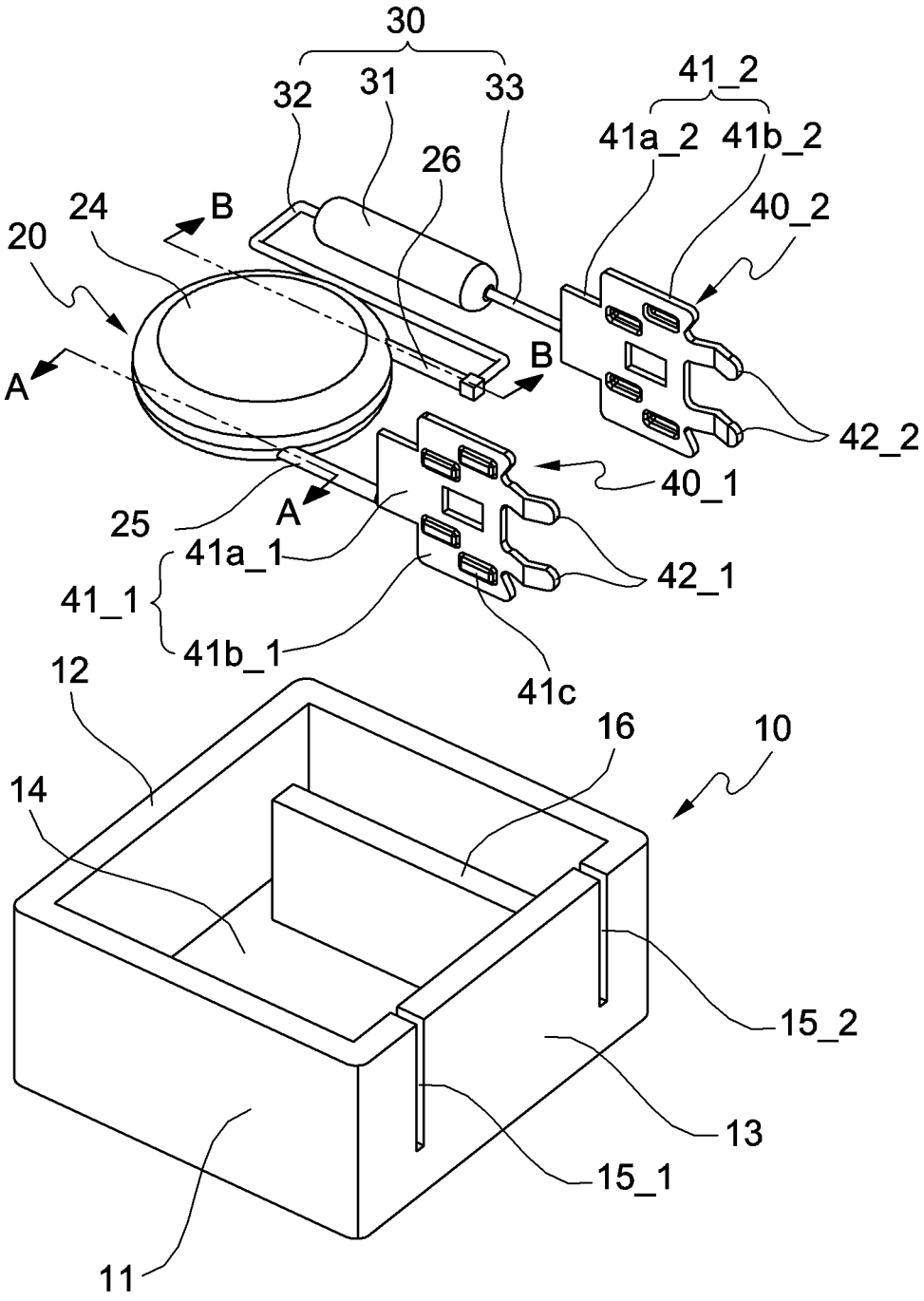
FIG. 2 is a perspective view of a circuit protection device according to a first embodiment of the present invention.
Figure 3A:
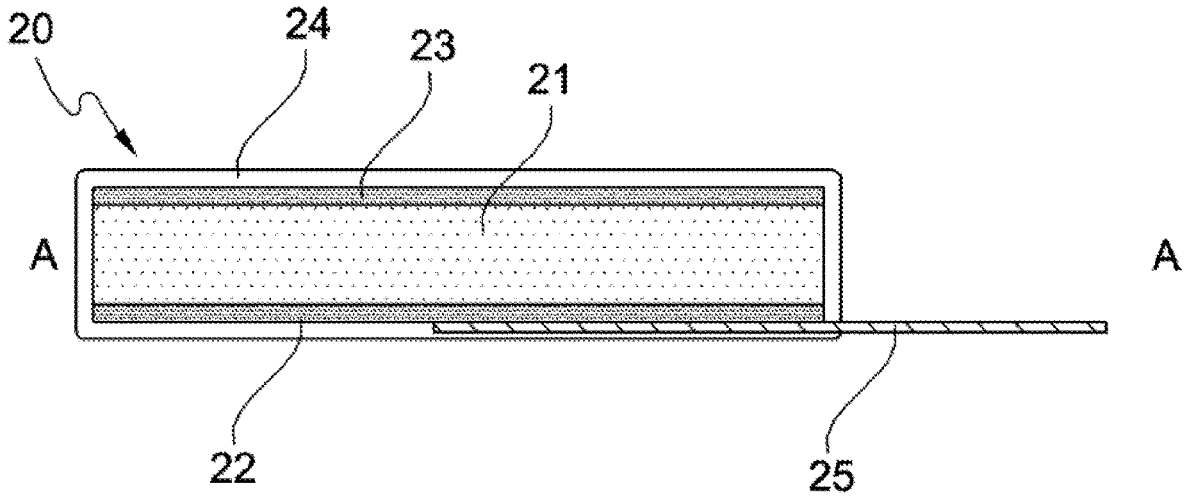
FIGS. 3A and 3B are cross-sectional views illustrating a negative temperature coefficient thermistor 20 taken along lines A-A and B-B, respectively.
Figure 3B:
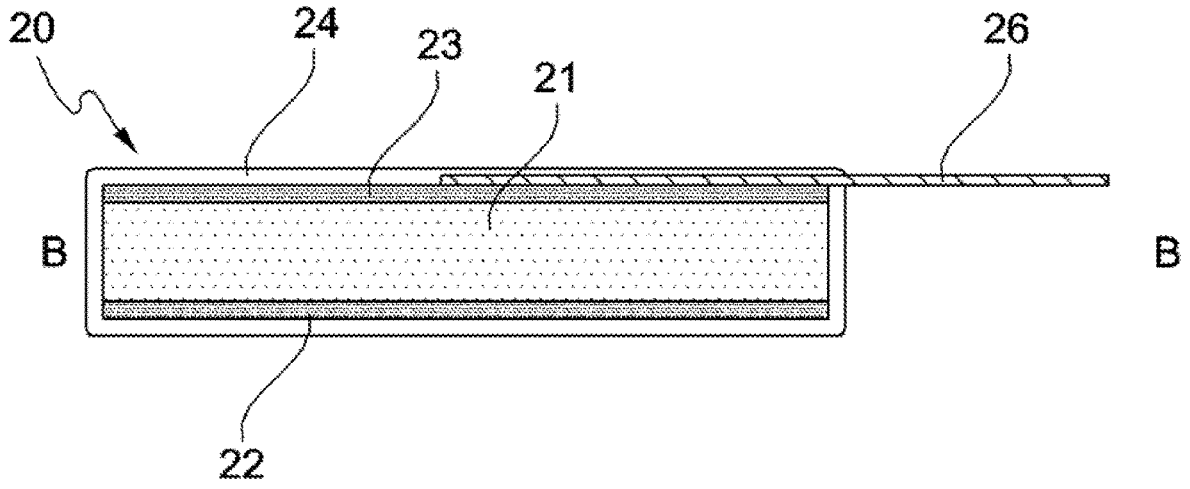
Figure 4:
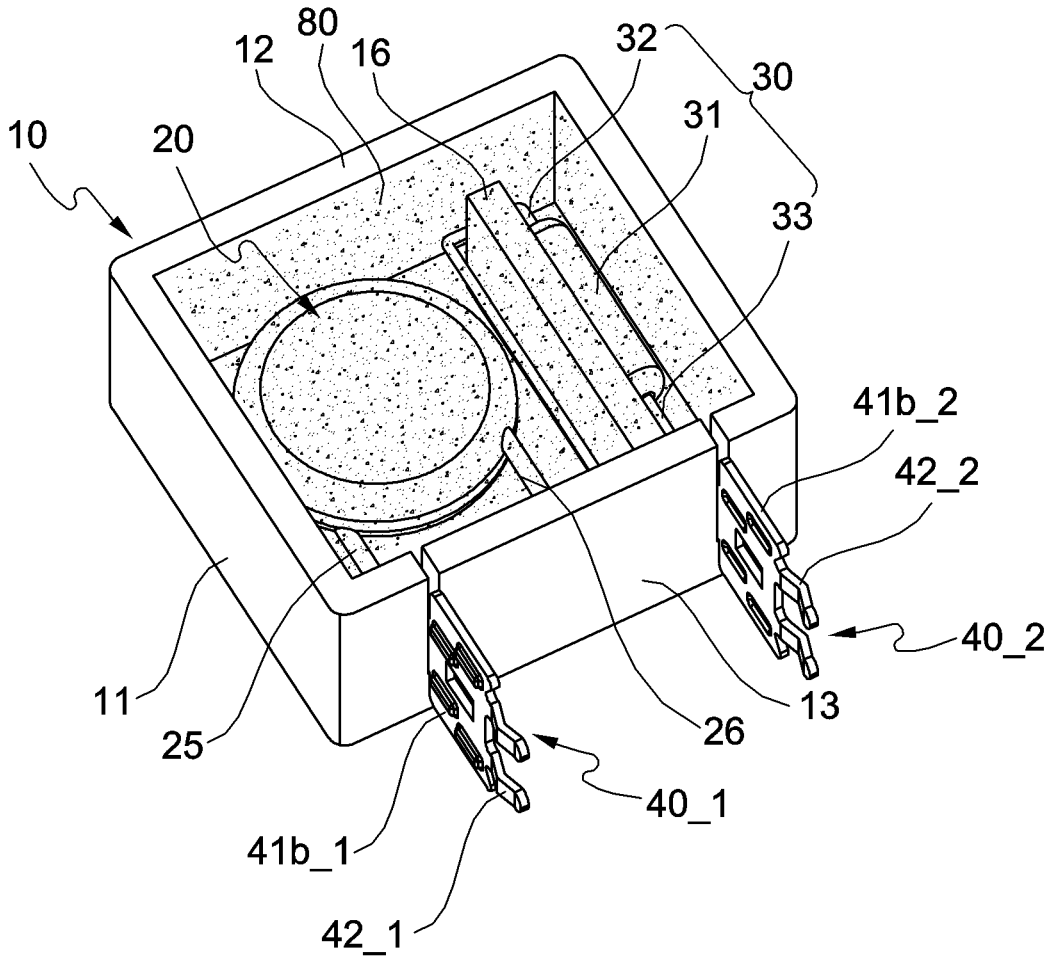
FIG. 4 is a perspective view illustrating a state in which a case 10 accommodates the negative temperature coefficient thermistor 20, a thermal fuse 30, and the like which are shown in FIG. 2 and then is filled with a filler.

FIGS. 2 to 4 are views illustrating components of a circuit protection device according to a first embodiment of the present invention. FIG. 2 is a perspective view of the circuit protection device according to the first embodiment. FIGS. 3A and 3B are cross-sectional views illustrating a negative temperature coefficient thermistor 20 taken along lines A-A and B-B, respectively. FIG. 4 is a perspective view illustrating a state in which a case 10 accommodates the negative temperature coefficient thermistor 20, a thermal fuse 30, and the like which are shown in FIG. 2 and then is filled with a filler.

The circuit protection device according to the first embodiment of the present invention includes the case 10, the negative temperature coefficient thermistor 20, the thermal fuse 30, a first pin 40_1, and a second pin 40_2.

The case 10 includes, for example, a ceramic material and includes both sidewalls 11 and a front wall 12, a rear wall 13, and a bottom wall 14 so as to form an accommodation groove with an open top in which the negative temperature coefficient thermistor 20 and the thermal fuse 30 are accommodated. A first guide groove 15_1 and a second guide groove 15_2 are formed on the rear wall 13 to guide the first pin 40_1 and the second pin 40_2 to be withdrawn outward from the case 10.

As shown in FIGS. 2 to 3B, the negative temperature coefficient thermistor 20 includes a resistant heating element 21, a pair of electrodes 22 and 23 installed on both sides of the resistant heating element 21, a first lead wire 25 and a second lead wire 26 withdrawn from the pair of electrodes 22 and 23, respectively, all of which are coated with a coating material 24.

A thermistor is a resistor element having a sensitively varying thermal resistance value and particularly has a feature in which an electrical resistance value varies according to a change of a temperature thereof or an ambient temperature. Among thermistors, a thermistor having a negative temperature coefficient is referred to as a negative temperature coefficient thermistor. The negative temperature coefficient thermistor has a resistance value which decreases according to an increase in a temperature thereof or an ambient temperature.

The thermal fuse 30 includes a thermal fuse body 31 and a third lead wire 32 and a fourth lead wire 33 connected to both ends of the thermal fuse body 31, respectively. Typically, the thermal fuse body 31 includes an insulating ceramic rod having a certain length and a fused body, and the third lead wire 32 and the fourth lead wire 33 may be connected to conductive caps installed respectively on both ends of the ceramic rod.

As shown in FIG. 2, the second lead wire 26 of the negative temperature coefficient thermistor 20 and the third lead wire 32 of the thermal fuse body 31 are connected to each other. The second lead wire 26 and the third lead wire 32 may be connected through soldering, arc welding, spot welding, laser soldering, clamping, or the like.

Meanwhile, the first pin 40_1 and the second pin 40_2 which are conductive materials connected to a circuit board to perform electrical connection between a circuit and a circuit protection device. One end of the first pin 40_1 is connected to the first lead wire 25 of the negative temperature coefficient thermistor 20 in the case 10 and extends through the first guide groove 15_1 such that the other end thereof is withdrawn outward from the case 10. One end of the second pin 40_2 is connected to the fourth lead wire 33 of the thermal fuse 30 in the case 10 and extends through the second guide groove 15_2 such that the other end thereof is withdrawn outward from the case 10.

In the embodiments of the present invention, the first pin 40_1 and the second pin 40_2 performs a function of performing electrical connection between the circuit and the circuit protection device, a function of emitting heat generated by the circuit protection device, and a function of spacing the case 10 apart at a certain interval from the circuit board when the circuit protection device is mounted on the circuit board.

The first pin 40_1 and the second pin 40_2 may include plate-shaped bodies 41_1 and 41_2 and extending portions 42_1 and 42_2 which extend from the bodies 41_1 and 41_2 with widths smaller than those of the bodies 41_1 and 41_2, respectively. Generally, the extending portions 42_1 and 42_2 are parts which are inserted into holes of the circuit board and soldered to perform electrical connection, and the bodies 41_1 and 41_2 are parts configured to emit heat and space the case 10 apart at a certain interval from the circuit board.

In detail, the first pin 40_1 may include the body 41_1 having one side connected to the first lead wire 25 and the extending portion 42_1 extending from the other side of the body 41_1 with a width smaller than that of the body 41_1. The second pin 40_2 may include the body 41_2 having one side connected to the fourth lead wire 33 and the extending portion 42_2 extending from the other side of the body 41_2 with a width smaller than that of the body 41_2. The first lead wire 25, the fourth lead wire 33, and the bodies 41_1 and 41_2 may be connected through soldering, arc welding, spot welding, laser soldering, clamping, or the like.

Also, the bodies 41_1 and 41_2 may include first parts **41*a*_1 and 41*a*_2 which have a relatively small width and second parts 41*b*_1 and 41*b*_2 which have a relatively great width. Generally, the first parts 41*a*_1 and 41*a*_2 are parts connected to the lead wires 25 and 33 and inserted into the guide grooves 15_1 and 15_2, and the second parts 41*b*_1 and 41*b*_2 are parts which are withdrawn outward from the case 10 so as to space the case 10 at a certain interval apart from the circuit board. Also, the second parts 41*b*_1 and 41*b*_2 may include one or more protruding portions 41*c*** configured to improve heat dissipation performance.

In detail, the body 41_1 of the first pin 40_1 includes the first part **41*a*_1 having one side connected to the first lead wire 25 and inserted into the first guide groove 15_1 and the second part 41*b*_1 extending from the other side of the first part 41*a*_1 with a width greater than that of the first part 41*a*_1 and withdrawn outward from the case 10. The body 41_2 of the second pin 40_2 includes the first part 41*a*_2 having one side connected to the fourth lead wire 33 and inserted into the second guide groove 15_2 and the second part 41*b*_2 extending from the other side of the first part 41*a*_2 with a width greater than that of the first part 41*a*_2 and withdrawn outward from the case 10**.

Meanwhile, since the negative temperature coefficient thermistor 20 and the thermal fuse 30 are disposed to be adjacent to each other in a sealed space in the case 10 such that a temperature of the circuit protection device or an ambient temperature thereof increases, the thermal fuse 30 may be short-circuited by heat generation of the negative temperature coefficient thermistor 20. Accordingly, a partition wall 16 may be installed between the resistant heating element 21 and the thermal fuse body 31 so as to maintain a certain interval or more between the resistant heating element 21 of the negative temperature coefficient thermistor 20 and the thermal fuse body 31. The partition wall 16 may extend from an inner wall, for example, a bottom wall 14 or a rear wall 13 of the case 10. The partition wall 16 is installed not to completely separate both spaces so as to form a path from which the second lead wire 26 and the third lead wire 32 extend.

Referring to FIG. 4, the case 10 is filled with a filler 80 while the negative temperature coefficient thermistor 20, the thermal fuse 30, and the like are accommodated in the case 10. The filler 80 not only supports the negative temperature coefficient thermistor 20 and the thermal fuse 30 in the accommodation grooves but also enables heat to be effectively dissipated from the negative temperature coefficient thermistor 20 and the thermal fuse 30. Accordingly, the filler 80 may be a material having high heat dissipation property.

According to a first embodiment of the present invention, since the negative temperature coefficient thermistor 20 has a resistance value which is great at room temperature or a relatively low temperature and decreases according to an increase in a temperature thereof or an ambient temperature, an inrush current is limited to a certain current using a great resistance value at driving time and a normal input current is maintained using a resistance value decreased by an increase in temperature after a certain time. At the same time, when the negative temperature coefficient thermistor 20 is overheated by overcurrent inflow due to circuit abnormality or ambient temperature rises abnormally, the thermal fuse 30 short-circuits and cuts off an inflow of current so as to prevent fire. Accordingly, the circuit protection device according to the first embodiment may replace an existing circuit protection device shown in FIG. 1. Also, since the negative temperature coefficient thermistor 20 has a relatively small volume and is low-priced in comparison to a high-current relay, a cost of the circuit protection device is reduced and a space is less occupied. Also, since a relay is not used, it is possible to remove a risk element caused by malfunction of the relay fundamentally.

Meanwhile, in the case of large home appliances such as an air conditioner, a washer, a refrigerator, a dryer, and the like, since it is necessary for the circuit protection device to accommodate high currents, a circuit protection device having good heat generation properties is required. In the case of the first embodiment, to reduce heat generation amount of the negative temperature coefficient thermistor 20, it is necessary to increase a size thereof. Here, as a size of the negative temperature coefficient thermistor 20 increases, manufacturing costs thereof geometrically increases. Accordingly, there is a limitation in reducing heat generation amount by simply increasing the size of the negative temperature coefficient thermistor 20.

Accordingly, hereinafter, as embodiments for reducing heat generation amount of a circuit protection device without increasing a size of a negative temperature coefficient thermistor as well as having all advantages of the first embodiment, there are provided embodiments for connecting two negative temperature coefficient thermistors in parallel to reduce heat generation amount using a lowered synthetic resistance value thereof. For convenience, in the following embodiments, a redundant description overlapped with the first embodiment will be omitted.

Figure 5:
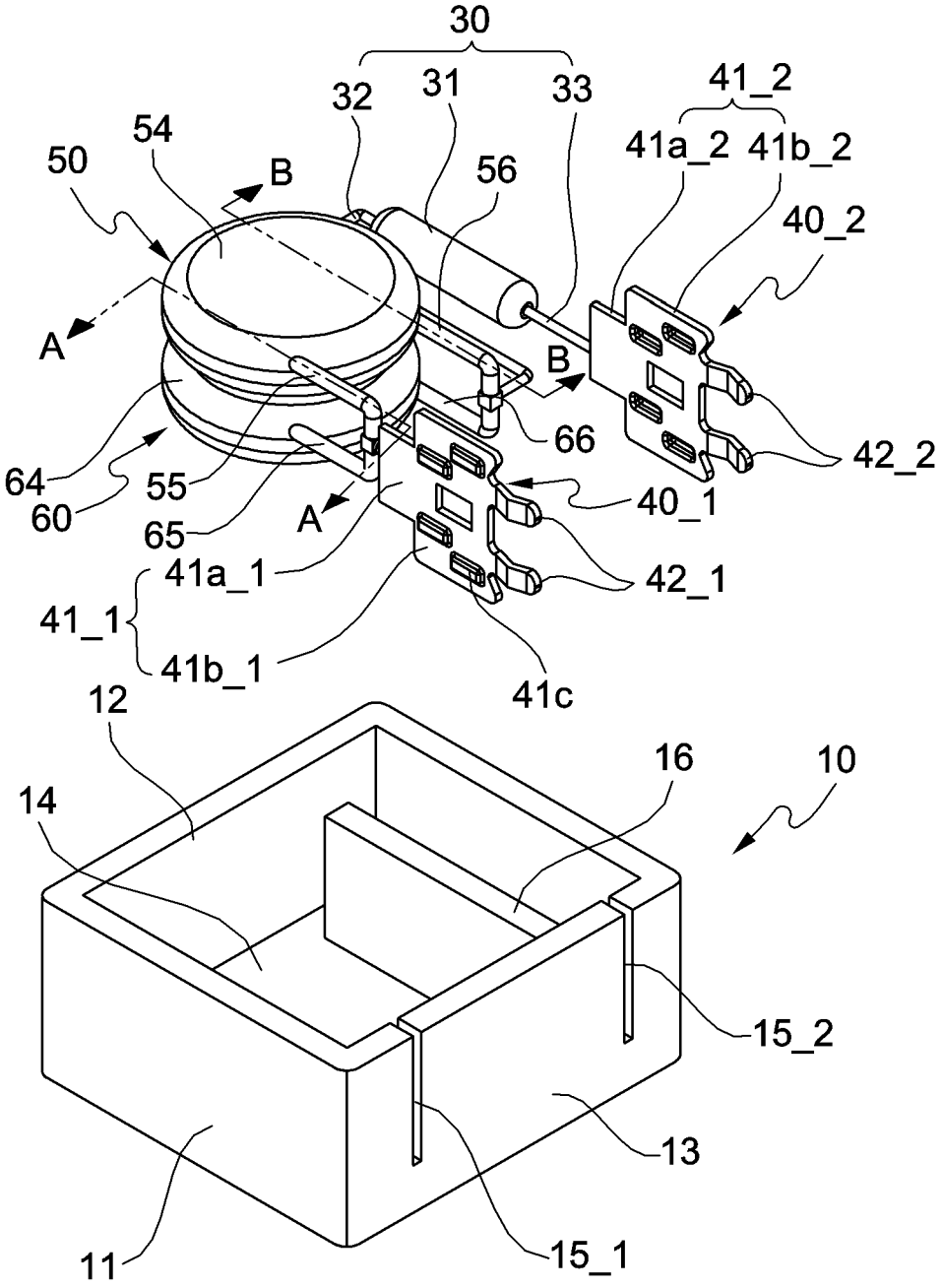
FIG. 5 is a perspective view of a circuit protection device according to a second embodiment of the present invention.
Figure 6A:
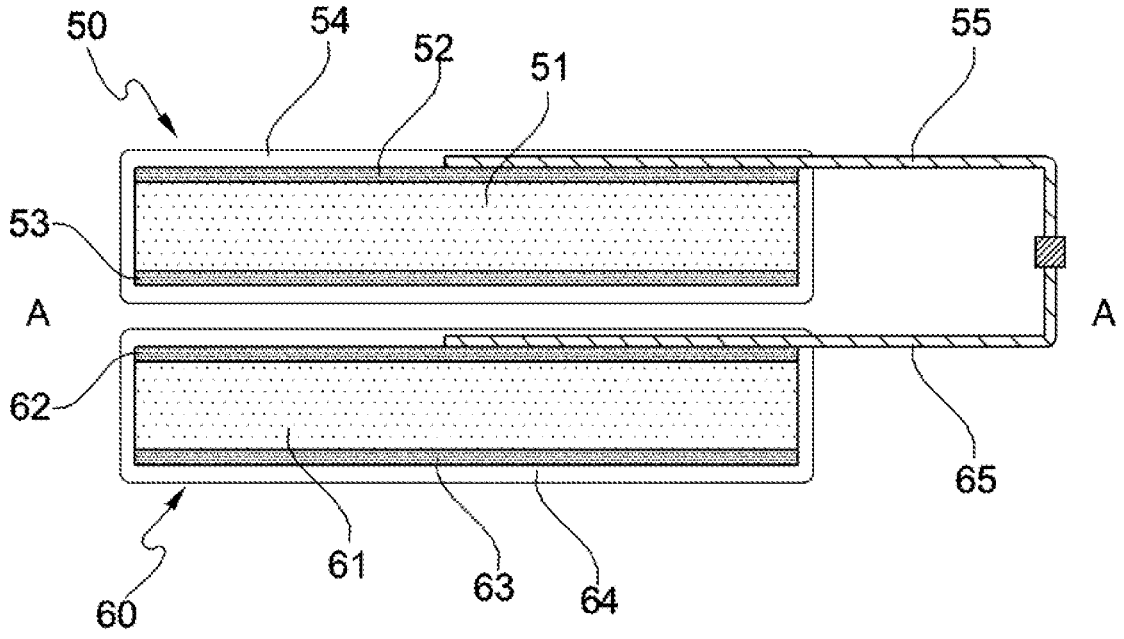
FIGS. 6A and 6B are cross-sectional views illustrating negative temperature coefficient thermistors 50 and 60 taken along lines A-A and B-B, respectively.
Figure 6B:
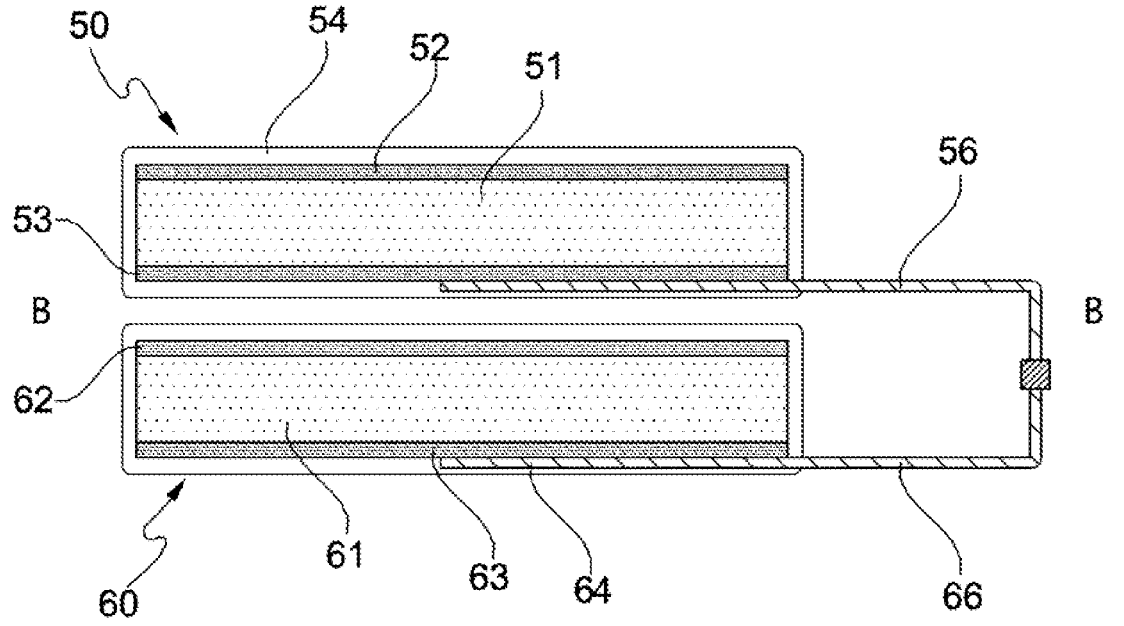
Figure 7:
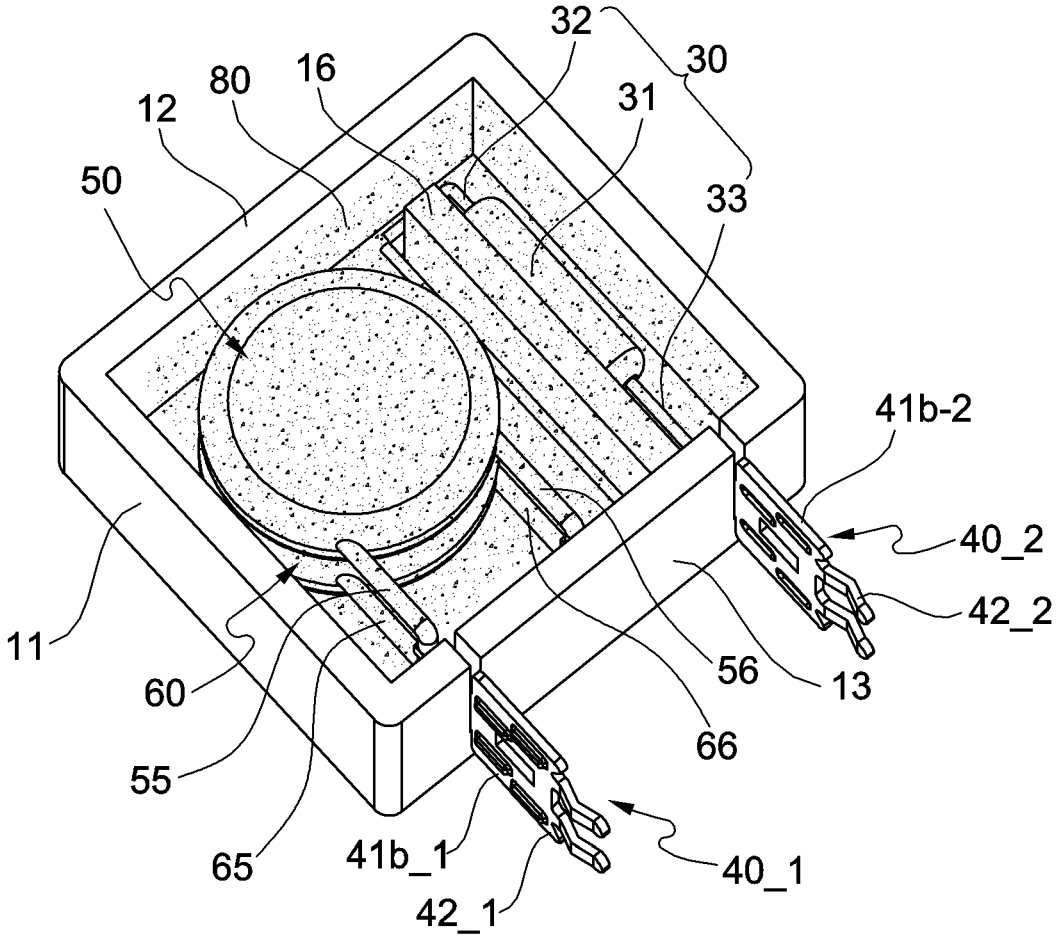
FIG. 7 is a perspective view illustrating a state in which the case 10 accommodates the negative temperature coefficient thermistors 50 and 60, the thermal fuse 30, and the like which are shown in FIG. 5 and then is filled with a filler.

FIGS. 5 to 7 are views illustrating components of a circuit protection device according to a second embodiment of the present invention. FIG. 5 is a perspective view of the circuit protection device according to the second embodiment. FIGS. 6A and 6B are cross-sectional views illustrating negative temperature coefficient thermistors 50 and 60 taken along lines A-A and B-B, respectively. FIG. 7 is a perspective view illustrating a state in which the case 10 accommodates the negative temperature coefficient thermistors 50 and 60, the thermal fuse 30, and the like which are shown in FIG. 5 and then is filled with a filler.

The circuit protection device according to the second embodiment of the present invention includes the case 10, a first negative temperature coefficient thermistor 50, a second negative temperature coefficient thermistor 60, the thermal fuse 30, the first pin 40_1, and the second pin 40_2.

The case 10 includes both sidewalls 11 and the front wall 12, the rear wall 13, and the bottom wall 14 so as to form an accommodation groove with an open top in which the first negative temperature coefficient thermistor 50, the second negative temperature coefficient thermistor 60, and the thermal fuse 30 are accommodated. The first guide groove 15_1 and the second guide groove 15_2 are formed on the rear wall 13 to guide the first pin 40_1 and the second pin 40_2 to be withdrawn outward from the case 10.

As shown in FIGS. 5 to 6B, the first negative temperature coefficient thermistor 50 includes a first resistant heating element 51, a pair of electrodes 52 and 53 installed on both sides of the first resistant heating element 51, a first lead wire 55 and a second lead wire 56 withdrawn from the pair of electrodes 52 and 53, respectively, all of which are coated with a coating material 54. Like the first negative temperature coefficient thermistor 50, the second negative temperature coefficient thermistor 60 includes a second resistant heating element 61, a pair of electrodes 62 and 63 installed on both sides of the second resistant heating element 61, and a third lead wire 65 and a fourth lead wire 66 withdrawn from the pair of electrodes 62 and 63, respectively, all of which are coated with a coating material 64.

The thermal fuse 30 includes the thermal fuse body 31 and a fifth lead wire 32 and a six lead wire 33 connected to both ends of the thermal fuse body 31, respectively.

Referring to FIGS. 5 to 6B, the first lead wire 55 of the first negative temperature coefficient thermistor 50 and the third lead wire 65 of the second negative temperature coefficient thermistor 60 are connected to each other, and the second lead wire 56 of the first negative temperature coefficient thermistor 50, the fourth lead wire 66 of the second negative temperature coefficient thermistor 60, and the fifth lead wire 32 of the thermal fuse 30 are connected to one another. The lead wires may be connected through soldering, arc welding, spot welding, laser soldering, clamping, or the like.

One end of the first pin 40_1 is connected to the first lead wire 55 of the first negative temperature coefficient thermistor 50 and the third lead wire 65 of the second negative temperature coefficient thermistor 60 in the case 10. One end of the second pin 40_2 is connected to the sixth lead wire 33 of the thermal fuse 30 in the case 10.

The first pin 40_1 may include the body 41_1 having one side connected to the first lead wire 55 and the third lead wire 65 and the extending portion 42_1 extending from the other side of the body 41_1 with a width smaller than that of the body 41_1. The second pin 40_2 may include the body 41_2 having one side connected to the sixth lead wire 33 and the extending portion 42_2 extending from the other side of the body 41_2 with a width smaller than that of the body 41_2. The lead wires may be connected to the bodies through soldering, arc welding, spot welding, laser soldering, clamping, or the like.

The body 41_1 of the first pin 40_1 includes the first part 41*a*_1 having one side connected to the first lead wire 55 and the third lead wire 65 and inserted into the first guide groove 15_1 and the second part 41*b*_1 extending from the other side of the first part 41*a*_1 with a width greater than that of the first part 41*a*_1 and withdrawn outward from the case 10. The body 41_2 of the second pin 40_2 includes the first part 41*a*_2 having one side connected to the sixth lead wire 33 and inserted into the second guide groove 15_2 and the second part 41*b*_2 extending from the other side of the first part 41*a*_2 with a width greater than that of the first part 41*a*_2 and withdrawn outward from the case 10.

Meanwhile, the partition wall 16 may be installed between the thermal fuse body 31 and the first and second resistant heating elements 51 and 61 of the first and second negative temperature coefficient thermistors 50 and 60 to maintain a certain interval between the thermal fuse body 31 and the first and second resistant heating elements 51 and 61.

Referring to FIG. 7, the case 10 is filled with the filler 80 while the first and second negative temperature coefficient thermistors 50 and 60, the thermal fuse 30, and the like are accommodated in the case 10. The filler 80 not only supports the first and second negative temperature coefficient thermistors 50 and 60 and the thermal fuse 30 in the accommodation grooves but also enables heat to be effectively dissipated from the first and second negative temperature coefficient thermistors 50 and 60 and the thermal fuse 30.

Meanwhile, in the embodiment, the first resistant heating element 51 and the second resistant heating element 61 have a plate shape overall and are disposed to be adjacent to and face each other. Since the first resistant heating element 51 and the second resistant heating element 61 are disposed to be adjacent and face each other, the size of the circuit protection device may be reduced while the first resistant heating element 51 and the second resistant heating element 61 thermally influence each other so as to reduce a thermal imbalance. That is, when currents flow through both the resistant heating elements 51 and 61, the resistant heating elements 51 and 61 generate heat. Here, heat may be transferred from a resistant heating element having a great heat generation amount to a resistant heating element having a small heat generation amount so as to relieve the thermal imbalance between the resistant heating elements 51 and 61.

Also, the first resistant heating element 51 and the second resistant heating element 61 may have same resistance value or have different resistance values. Since the first resistant heating element 51 and the second resistant heating element 61 have a parallel connection structure even having any resistance values, a synthetic resistance value is smaller than a resistance value of the first resistant heating element 51 and a resistance value of the second resistant heating element 61. Accordingly, it is possible to implement a circuit protection device having a relatively small synthetic resistance value, which is difficult to be implemented by the first resistant heating element 51 or the second resistant heating element 61 alone.

Particularly, when the first resistant heating element 51 and the second resistant heating element 61 have different resistance values, heat from one of the first resistant heating element 51 and the second resistant heating element 61 which has a greater resistance value is transferred to another thereof which has a smaller resistance value so as to promote a resistance variation of the resistant heating element having the smaller resistance value. For example, when inrush currents are applied to a resistant heating element having a resistance value of 5Ω and a resistant heating element having a resistance value of 5.1Ω, the resistant heating element having the resistance value of 5Ω is reduced in resistance to 0.2Ω so that a temperature increases to 130° C. However, the resistant heating element having the resistance value of 5. 1Ω is slightly reduced in resistance to 4Ω so that a temperature increases to 45° C. Accordingly, even when a difference between the resistance values of the two resistant heating elements is small, a thermal imbalance is temporarily caused between both the thermistors. However, the thermal imbalance is reduced or relieved with time. Here, since the heat generated from the resistant heating element having the resistance value of 5Ω is transferred to the resistant heating element having the resistance value of 5.1Ω so as to much reduce the resistance value of the resistant heating element having the resistance value of 5.1Ω, a current amount increases even in the resistant heating element having the resistance value of 5.1Ω so that heat is further generated even in the resistant heating element having the resistance value of 5.1Ω so as to relieve the thermal imbalance between both the resistant heating elements and actually maintain a certain temperature in a thermal balanced state.

Figure 8:
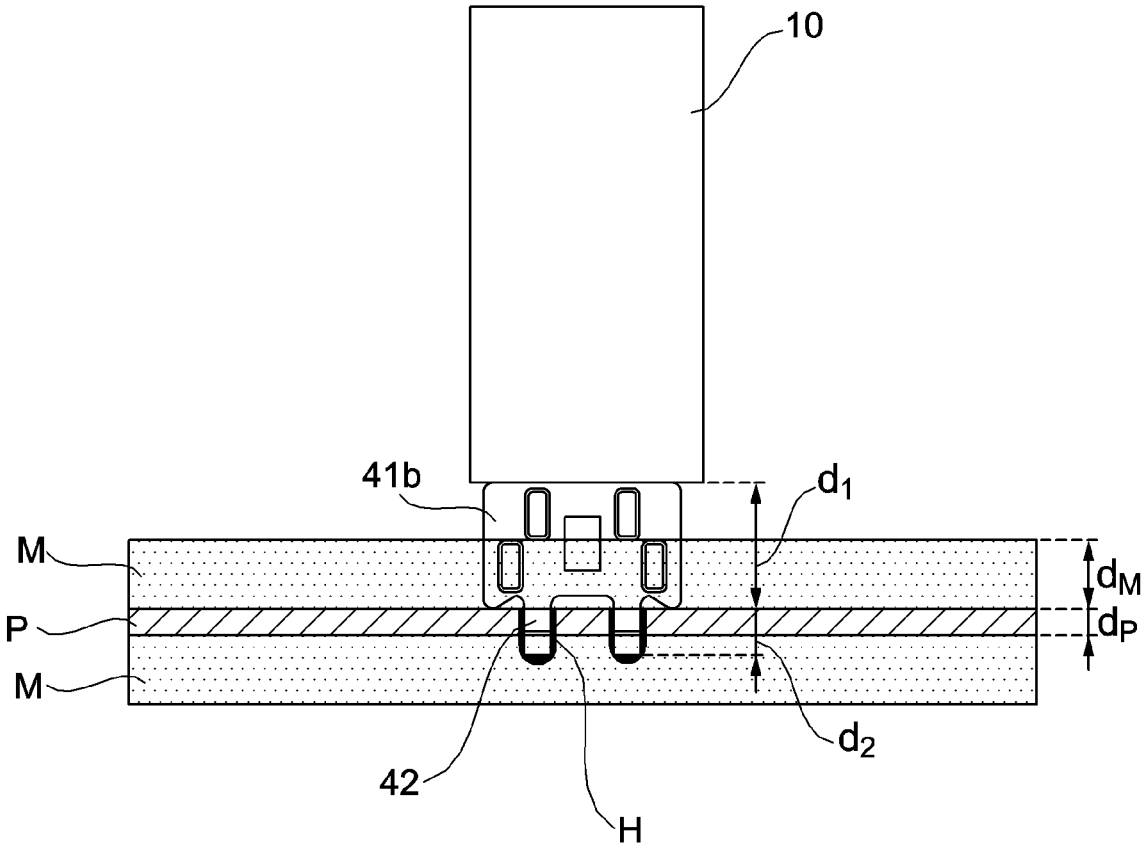
FIG. 8 illustrates a state in which the circuit protection device according to the first or second embodiment of the present invention is mounted on a circuit board.

FIG. 8 illustrates a state in which the circuit protection device according to the first or second embodiment of the present invention is mounted on a circuit board P.

Referring to FIG. 8, extending portions 42 of the pin 40 of the circuit protection device are inserted into to pass through a hole H formed in the circuit board P and soldered so that the circuit protection device is fixed to the circuit board P and electrically connected to an electrical circuit on the circuit board P. Accordingly, a length d2 of the extending portions is formed to be greater than a thickness dP of the circuit board P.

Meanwhile, in the case of an electronic product such as a washer or a dryer to which water is supplied or from which water is generated, the circuit board P is molded with a molding portion M having a waterproof material such as urethane and the like to protect the circuit board P from water. Since the molding portion M is relatively vulnerable to heat, when heat generated from the circuit protection device is transferred directly to the molding portion M, the molding portion M may be melted and disrupt waterproof performance. Accordingly, it is necessary to install the case 10 of the circuit protection device to be spaced at a certain interval apart from the circuit board P or the molding portion M. The second part 41*b* of the pin 40 which is withdrawn outward from the case 10 is installed so that the case 10 is spaced at a certain interval apart from the circuit board P or the molding portion M. The case 10 is spaced as much as a height d1 of the second part 41*b* apart from the circuit board P. When a thickness of the molding portion M is referred to as dM, the case 10 is spaced as much as d1-dM apart from the molding portion M. Accordingly, d1 may be greater than dM. Also, the molding portion M diffuses heat from the circuit protection device so as to assist heat dissipation.

After resistant heating elements having a diameter of 15 ϕ and a resistance value of 8Ω (a synthetic resistance of 4Ω) are used for the first resistant heating element 51 and the second resistant heating element 61 in the second embodiment and a current of 4.4 A is applied to a circuit protection device for a certain time (fifteen minutes), a result of measuring a heat generation temperature of the resistant heating elements, a heat generation temperature of a bottom end of the case 10, and a heat generation temperature of a soldered part of the circuit board P is shown in Table 1.

TABLE 1

| | Resistant heating element | Bottom end of case | Soldered part | remarks |
|---|---|---|---|---|
| Heat generation temperature (° C.) | 106.0 | 88.3 | 73.6 | Without urethane molding |
| Heat generation temperature (° C.) | 110.4 | 85.6 | 67.8 | With urethane molding |

As shown in Table 1, the temperature of the bottom end of the case, which influences the molding M or the circuit board P directly, adequately decreased rather than the temperature of the resistant heating elements and even the temperature of the soldered part of the circuit board P was 73.6° C. and 67.8° C. which are allowed values. Particularly, the temperature of the bottom end of the case and the temperature of the soldered part were lower in the case with a urethane molding than in the case without urethane molding due to a heat dissipation function of the urethane molding.

Figure 9:
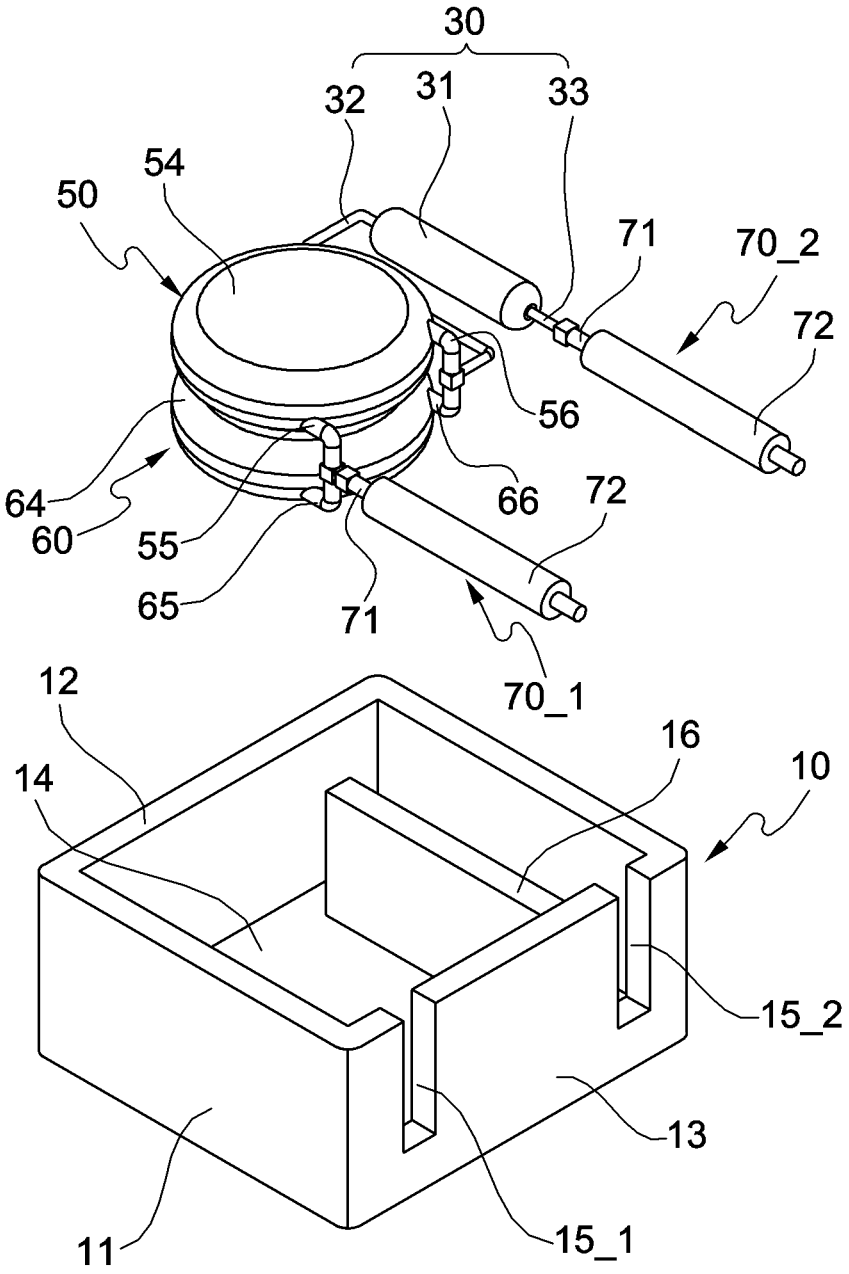
FIG. 9 is a perspective view of a circuit protection device according to a third embodiment of the present invention.
Figure 10:
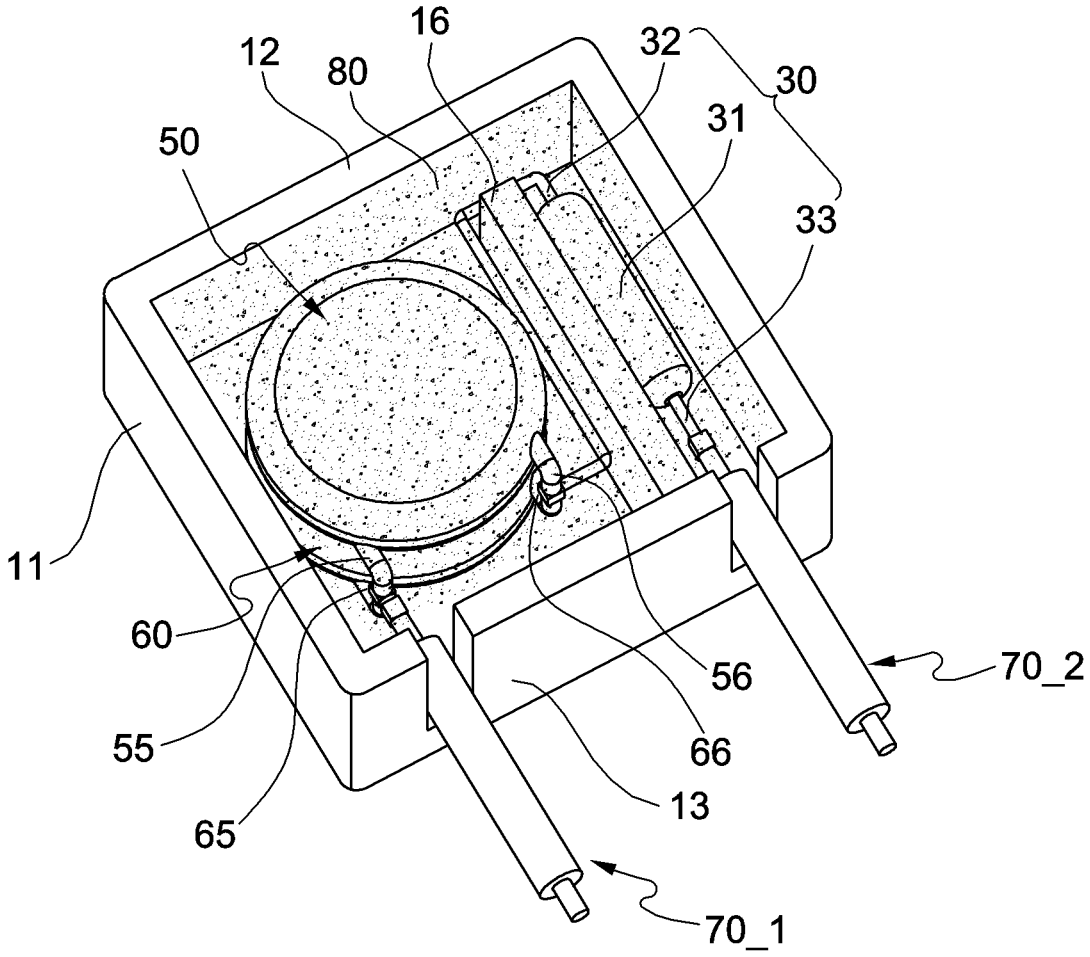
FIG. 10 is a perspective view illustrating a state in which the case 10 accommodates the negative temperature coefficient thermistors 50 and 60, the thermal fuse 30, and the like which are shown in FIG. 9 and then is filled with a filler.

FIGS. 9 to 10 are views illustrating components of a circuit protection device according to a third embodiment of the present invention. FIG. 9 is a perspective view of the circuit protection device according to the third embodiment. FIG. 10 is a perspective view illustrating a state in which the case 10 accommodates the negative temperature coefficient thermistors 50 and 60, the thermal fuse 30, and the like which are shown in FIG. 9 and then is filled with a filler.

In comparison to the second embodiment, in the third embodiment, the first pin 40_1 and the second pin 40_2 are replaced with a first cable 70_1 and a second cable 70_2, respectively. That is, in the embodiment, the circuit protection device is implemented not to be installed directly on the circuit board and to be installed separately from the circuit board and to be connected to a corresponding terminal of the circuit board using the first cable 70_1 and the second cable 70_2. For convenience, in the third embodiment, a redundant description overlapped with the second embodiment will be omitted.

The first cable 70_1 and the second cable 70_2 each include a conducting wire 71 and a coating 72 enclosing the conducting wire 71. The first cable 70_1 and the second cable 70_2 may be harness cables.

In the first cable 70_1, one end of the conducting wire 71 is connected to the first lead wire 55 of the first negative temperature coefficient thermistor 50 and the third lead wire 65 of the second negative temperature coefficient thermistor 60 in the case 10 and extends through the first guide groove 15_1 such that the other end thereof is withdrawn outward from the case 10. In the second cable 70_2, one end of the conducting wire 71 is connected to the sixth lead wire 33 of the thermal fuse 30 in the case 10 and extends through the second guide groove 15_2 such that the other end thereof is withdrawn outward from the case 10.

Since the circuit protection device according to the third embodiment is installed separately from the circuit board, there is an advantage in which heat generated at the circuit protection device is never transferred to the circuit board.

A circuit protection device according to the present invention can replace a circuit protection device including a fuse resistor RF, a first relay S1, and a second relay S2 and includes a negative temperature coefficient thermistor and a thermal fuse which are low-priced so as to reduce costs. Also, the negative temperature coefficient thermistor and the thermal fuse have a small volume in comparison to relays to less occupy a space and the relays are not used, it is possible to fundamentally remove a risk of an overcurrent or fire caused by a malfunction of the relays.

The exemplary embodiments of the present invention have been described above. It should be understood by one of ordinary skill in the art that the present invention may be implemented as a modified form without departing from the essential features of the present invention. Therefore, the disclosed embodiments should be considered not in a limitative view but a descriptive view. The scope of the present invention will be shown in the claims not in the above description, and all differences within an equivalent range thereof should be construed as being included in the present invention.

What is claimed is:

1. A circuit protection device comprising:

a case;

a negative temperature coefficient thermistor which is accommodated in the case and comprises a resistant heating element, a pair of electrodes installed on both sides of the resistant heating element, a first lead wire and a second lead wire withdrawn from the pair of electrodes, and a first pin connected to the first lead wire, respectively; and a thermal fuse which is accommodated in the case and comprises a thermal fuse body and a third lead wire and a fourth lead wire connected to both ends of the thermal fuse body, and a second pin connected to the fourth lead wire, respectively, wherein the second lead wire and the third lead wire are connected to each other in the case, wherein a first guide groove configured to guide the first pin to be withdrawn outward from the case and a second guide groove configured to guide the second pin to be withdrawn outward from the case are formed in the case, and wherein the first pin and the second pin comprise plate-shaped bodies having one side connected to the first lead wire and the fourth lead wire, respectively, and each comprise at least one extending portion extending from an other side of the body with a width smaller than that of the body.

2. The circuit protection device of claim 1, wherein the bodies of the first pin and the second pin comprise first parts having one side connected to the first lead wire and the fourth lead wire and inserted into the first guide groove and the second guide groove, respectively, and comprise second parts having one sides extending from other sides of the first parts with a width greater than that of the first parts and withdrawn outward from the case.

3. The circuit protection device of claim 1, wherein the case comprises a partition wall extending from an internal wall of the case and disposed between the resistant heating element and the thermal fuse body.

4. A circuit protection device comprising:

a case;

a first negative temperature coefficient thermistor which is accommodated in the case and comprises a first resistant heating element, a pair of electrodes installed on both sides of the first resistant heating element, and a first lead wire and a second lead wire withdrawn from the pair of electrodes, respectively;

a second negative temperature coefficient thermistor which is accommodated in the case and comprises a second resistant heating element, a pair of electrodes installed on both sides of the second resistant heating element, and a third lead wire and a fourth lead wire withdrawn from the pair of electrodes, respectively; and a thermal fuse which is accommodated in the case and comprises a thermal fuse body and a fifth lead wire and a sixth lead wire connected to both ends of the thermal fuse body, respectively, wherein the first lead wire and the third lead wire are connected to each other in the case, and wherein the second lead wire, the fourth lead wire, and the fifth lead wire are connected to one another in the case.

5. The circuit protection device of claim 4, further comprising:

a first pin connected to the first lead wire and the third lead wire; and a second pin connected to the sixth lead wire, wherein a first guide groove configured to guide the first pin to be withdrawn outward from the case and a second guide groove configured to guide the second pin to be withdrawn outward from the case are formed in the case.

6. The circuit protection device of claim 5, wherein the first pin comprises a plate-shaped body having one side connected to the first lead wire and the third lead wire and comprises at least one extending portion extending from an other side of the body with a width smaller than that of the body.

7. The circuit protection device of claim 6, wherein the body comprises a first part having one side connected to the first lead wire and the third lead wire and inserted into the first guide groove and comprises a second part extending from another side of the first part with a width greater than that of the first part to be located outside the case.

8. The circuit protection device of claim 5, wherein the second pin comprises a plate-shaped body having one side connected to the sixth lead wire and comprises at least one extending portion extending from an other side of the body with a width smaller than that of the body.

9. The circuit protection device of claim 8, wherein the body comprises a first part having one side connected to the sixth lead wire and inserted into the second guide groove and comprises a second part extending from another side of the first part with a width greater than that of the first part to be located outside the case.

10. The circuit protection device of claim 4, wherein the case comprises a partition wall extending from an internal wall of the case and disposed between the thermal fuse body and the first resistant heating element and the second resistant heating element.

11. The circuit protection device of claim 4, wherein the first resistant heating element and the second resistant heating element are disposed to face each other.

12. The circuit protection device of claim 4, further comprising:

a first cable having one end connected to the first lead wire and the third lead wire; and a second cable having one end connected to the sixth lead wire, wherein a first guide groove configured to guide the first cable to be withdrawn outward from the case and a second guide groove configured to guide the second cable to be withdrawn outward from the case are formed in the case.

* * * * *